US011771182B2

(12) United States Patent
Evans et al.

(10) Patent No.: US 11,771,182 B2
(45) Date of Patent: Oct. 3, 2023

(54) BELT BUCKLE

(71) Applicant: Edge-Works Manufacturing Company, Burgaw, NC (US)

(72) Inventors: Scott V. Evans, Jacksonville, NC (US); Nicholas R. Tomczak, Richlands, NC (US)

(73) Assignee: Edge-Works Manufacturing Company, Burgaw, NC (US)

( * ) Notice: Subject to any disclaimer, the term of this patent is extended or adjusted under 35 U.S.C. 154(b) by 0 days.

(21) Appl. No.: 18/114,356

(22) Filed: Feb. 27, 2023

(65) Prior Publication Data

US 2023/0210226 A1 Jul. 6, 2023

Related U.S. Application Data

(63) Continuation of application No. PCT/US2021/047841, filed on Aug. 27, 2021.

(Continued)

(51) Int. Cl.

| | |
|---|---|
| ***A44B 11/26*** | (2006.01) |
| ***A44B 11/06*** | (2006.01) |
| ***A44B 11/25*** | (2006.01) |

(52) U.S. Cl.

CPC ..... *A44B 11/266* (2013.01); *A44B 11/06* (2013.01); *A44B 11/2592* (2013.01)

(58) Field of Classification Search

CPC . A44B 11/2592; A44B 11/258; A44B 11/266; A44B 11/2546; A44B 11/25; A44B 11/2519; A44B 11/263; A44B 11/06

See application file for complete search history.

(56) References Cited

U.S. PATENT DOCUMENTS

| | | | | |
|---|---|---|---|---|
| 2,580,769 A | | 1/1952 | Harman | |
| 2,629,156 A | * | 2/1953 | Kamens | A44C 5/2052 24/657 |

(Continued)

FOREIGN PATENT DOCUMENTS

| | | |
|---|---|---|
| CN | 109567320 | 4/2019 |
| EP | 0133068 | 2/1985 |
| FR | 2867661 | 9/2005 |

OTHER PUBLICATIONS

Thomas, Shane; International Search Report and Written Opinion of the International Search Authority (USPTO) for PCT/US2021/047841.

(Continued)

*Primary Examiner* — Jack W Lavinder

(74) *Attorney, Agent, or Firm* — Stephen M. Kepper; Intellectual Property Consulting, LLC

(57) ABSTRACT

A buckle according to the present invention has two opposing ends that are removably attached to each other using a locking system. On one end of the buckle, the locking system includes two opposing locking pins coupled to a spring that is fully enclosed and protected from external elements. On the other end, corresponding rivets or pin casings with plungers are operable to receive the locking pins and lock the two ends together or push the pins out of the casings to release the buckle. The buckle may also include a plug that is removably attached to the adjustable loop end and allows the central bar of the adjustable loop end to be removed without deforming the central bar. Alternatively, each end of the buckle may include self-aligning tabs that guide the ends of the buckle for fastening and aid in the stability of the buckle.

12 Claims, 11 Drawing Sheets

Related U.S. Application Data

(60) Provisional application No. 63/071,752, filed on Aug. 28, 2020.

(56) References Cited

U.S. PATENT DOCUMENTS

| | | | | |
|---|---|---|---|---|
| 2,941,272 | A * | 6/1960 | Bourguignon | B64D 17/32 24/657 |
| 3,090,092 | A | 5/1963 | Szemplak | |
| 3,201,840 | A * | 8/1965 | Jantzen | A44B 11/2519 24/639 |
| 3,523,340 | A | 8/1970 | Stoffel | |
| 4,675,956 | A * | 6/1987 | Cohen | A44B 11/2519 24/642 |
| 5,649,341 | A | 7/1997 | Ashline | |
| 6,694,578 | B1 * | 2/2004 | Nicoll | A44B 11/2519 24/642 |
| 7,263,749 | B2 * | 9/2007 | Benedict | A44B 11/2519 24/642 |
| 7,350,277 | B1 * | 4/2008 | Canfield | A44B 11/253 24/637 |
| 7,574,785 | B1 * | 8/2009 | Chen | A45C 13/30 383/70 |
| 8,572,820 | B2 * | 11/2013 | Richards | A44B 11/2519 24/648 |
| 9,101,185 | B1 * | 8/2015 | Greenberg | A45C 13/1069 |
| 11,109,648 | B1 * | 9/2021 | Crawford | A44B 11/2515 |
| 2004/0255439 | A1 * | 12/2004 | Benedict | A44B 11/2519 24/640 |
| 2012/0044031 | A1 | 2/2012 | Ninomiya | |
| 2016/0360838 | A1 * | 12/2016 | Casebolt | A44B 11/065 |
| 2019/0208867 | A1 | 7/2019 | Evans et al. | |

OTHER PUBLICATIONS

Demand for International Preliminary Examination, including Remarks and Art. 34 Amendments.

Batson, Victor; Written Opinion of the International Preliminary Examining Authority (USPTO) for PCT/US2021/047841.

* cited by examiner

BELT BUCKLE

RELATED APPLICATIONS

This application is a continuation to PCT/US2021/047841, filed Aug. 27, 2021, which claims priority to U.S. Provisional Patent Application No. 63/071,752, filed Aug. 28, 2020. The entire contents of the above application are hereby incorporated by reference as though fully set forth herein.

FIELD

The present invention relates in general to the field of buckles. More specifically, the present invention relates to fasteners for adjustably interconnecting belts or straps.

BACKGROUND

Various adjustable strap fasteners or buckles are known in the prior art which may be manipulated to adjust the effective length of a strap as used on, for example, a safety harness line. Such fasteners are usually made of a plastic or metal material and formed into an integral molded structure which generally comprises a fixed loop end and adjustable loop end. In use, one strap end portion is looped through a strap or belt opening on the fixed loop end and secured in place as by stitching or riveting. The other strap end portion which is adapted for length adjustment is looped through one belt or strap opening on the adjustable loop end, around a central cross bar, and looped back through a second strap or belt opening on the adjustable loop end and frictionally gripped therebetween against displacement. Typically, these cross bars must be made of a material that allows it to be deformed then straightened to fit within the adjustable loop end. Because they must be malleable, these cross bars are prone to failure with continued use.

Although there have been improvements to these belt buckles to withstand higher loads and pressure against the adjustable loop central cross bar, there remains a need for higher performing buckles that are capable of accommodating higher loads with improved stability and durability.

BRIEF SUMMARY OF THE INVENTION

It is the object of the present invention to address several challenges in previous attempts to achieve increased stability and load capacity with a load applied via belts or straps and mounted with a buckle.

A buckle according to the present invention has two opposing ends that are removably attached to each other using a locking system. For this embodiment, one end comprises two opposing locking pins coupled together by a spring. The spring is encased within a fully enclosed grease well or cavity and the pins are operable to move in a lateral direction in and out of the grease well. When extended, the spring-loaded pins protrude in a lateral direction beyond the exterior surface of the end of the buckle. The other end of the buckle comprises corresponding pin casings operable to receive the locking pins on one end and having a plunger disposed on an opposing end. The first and second ends are fastened together when the pins of the first end are inserted into the pin casings of the second end, and the ends are unfastened when the locking pins are pushed out of the pin casings by the plungers.

In an alternative embodiment, the two ends of the buckle comprise an adjustable loop end and a fixed loop end, with the adjustable loop end comprising a first and second belt opening with a removable central bar between the two openings and a plug that is operable to secure the central bar in place during use. When the plug is removed, the central bar can be removed from the adjustable loop end without having to deform the central bar. In yet another embodiment, the adjustable loop end includes recessed slots that guide the terminal ends of the central bar into place and provide additional support and stability.

In yet another embodiment, the two ends of the belt buckle comprise a plurality of tabs positioned along the perimeter of the adjustable loop end and fixed loop end such that the tabs assist with the aligning the two ends for fastening purposes as well as further prevent the buckle itself from rotating under increased loads.

DETAILED DESCRIPTION

Figure 1:
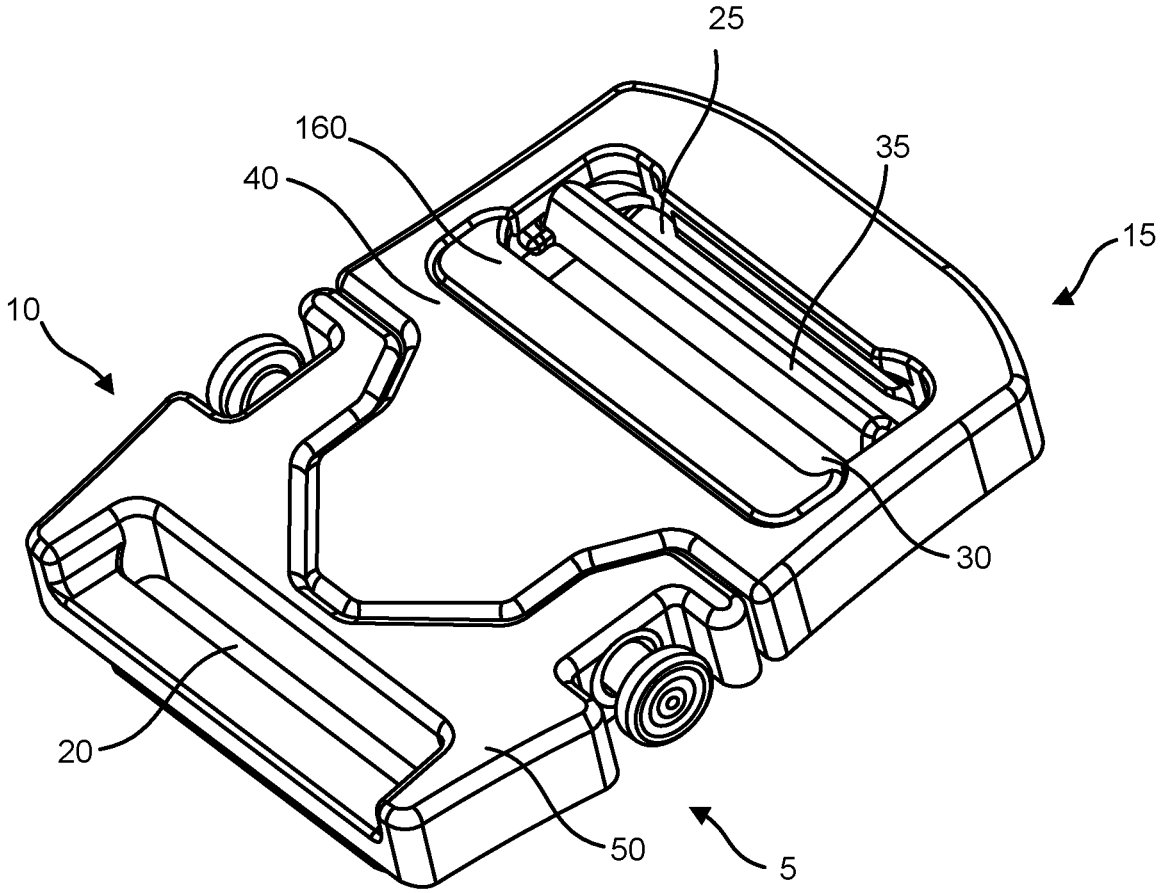
FIG. 1 is a top perspective view of the belt buckle in a closed configuration.
Figure 2:
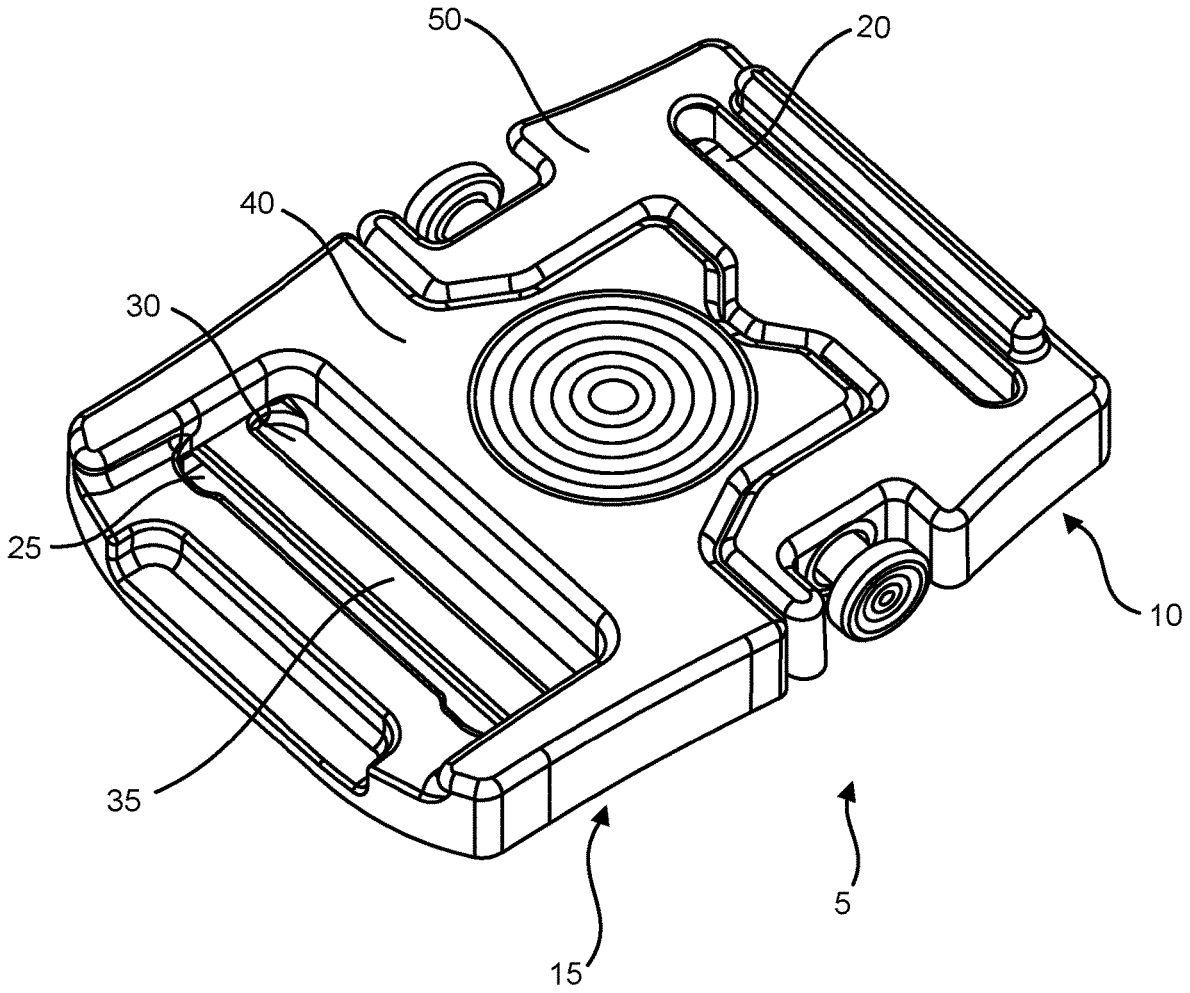
FIG. 2 is a bottom perspective view of the belt buckle in a closed configuration.

Turning to FIGS. 1-4, alternative perspective views of the belt buckle 5 in the open configuration and closed configuration are shown. The belt buckle 5 includes a fixed loop end 10 attached to an adjustable loop end 15. The fixed loop end 10 has only one strap or belt opening 20 to connect a strap or belt in a fixed manner to the fixed loop end 10 (by guiding it through the strap or belt opening 20 and sewing it), while the adjustable loop end 15 has two strap or belt openings 25, 30, located at both sides of a displaceable central bar 35, in order to connect a strap or belt to the adjustable loop end 15 in an adjustable fashion. Here, the end of the strap or belt is pulled from the rear lower surface of the adjustable loop end 15 through the strap or belt opening 30, over the central bar 35, and further through the strap or belt opening 25.

Figure 3:
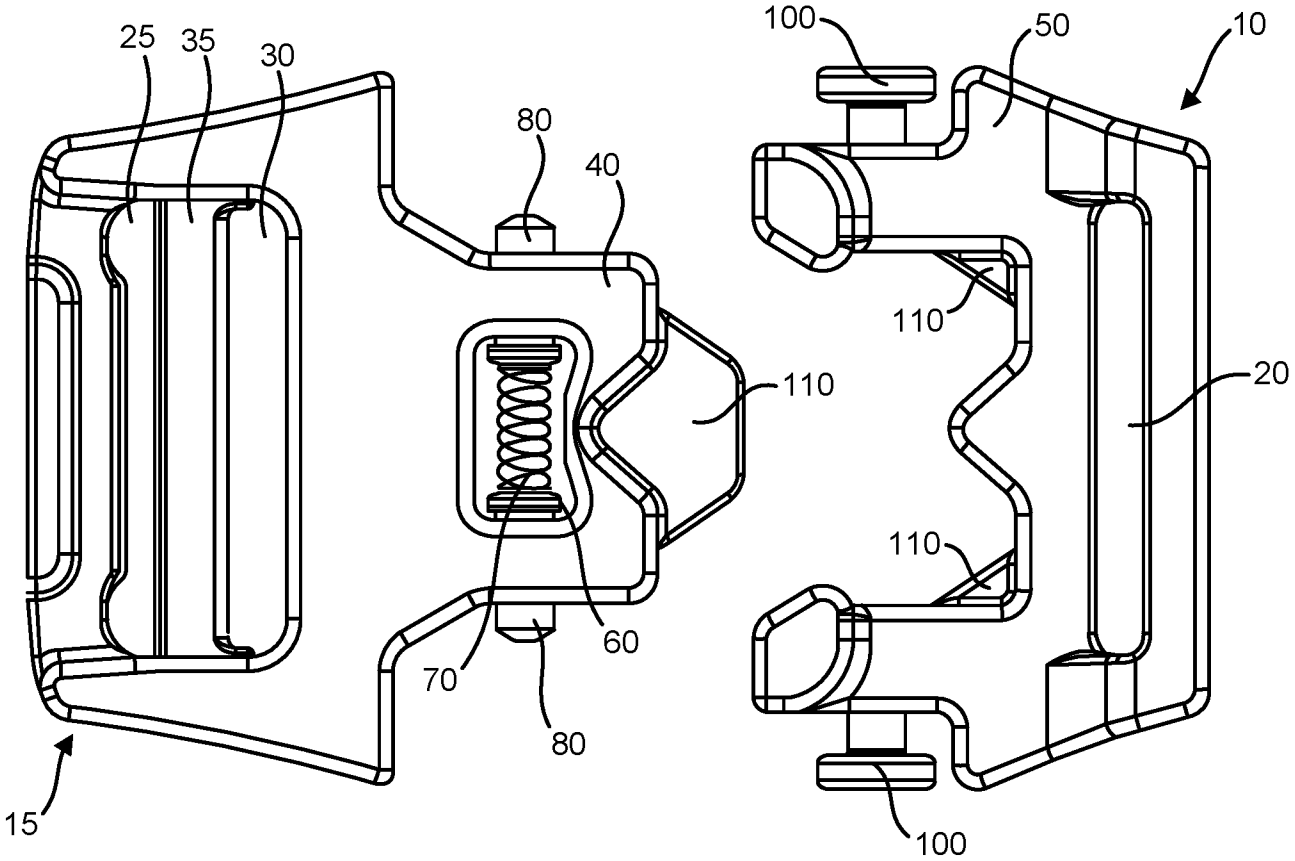
FIG. 3 is a bottom view of the belt buckle in an open configuration showing the internal grease well.
Figure 4:
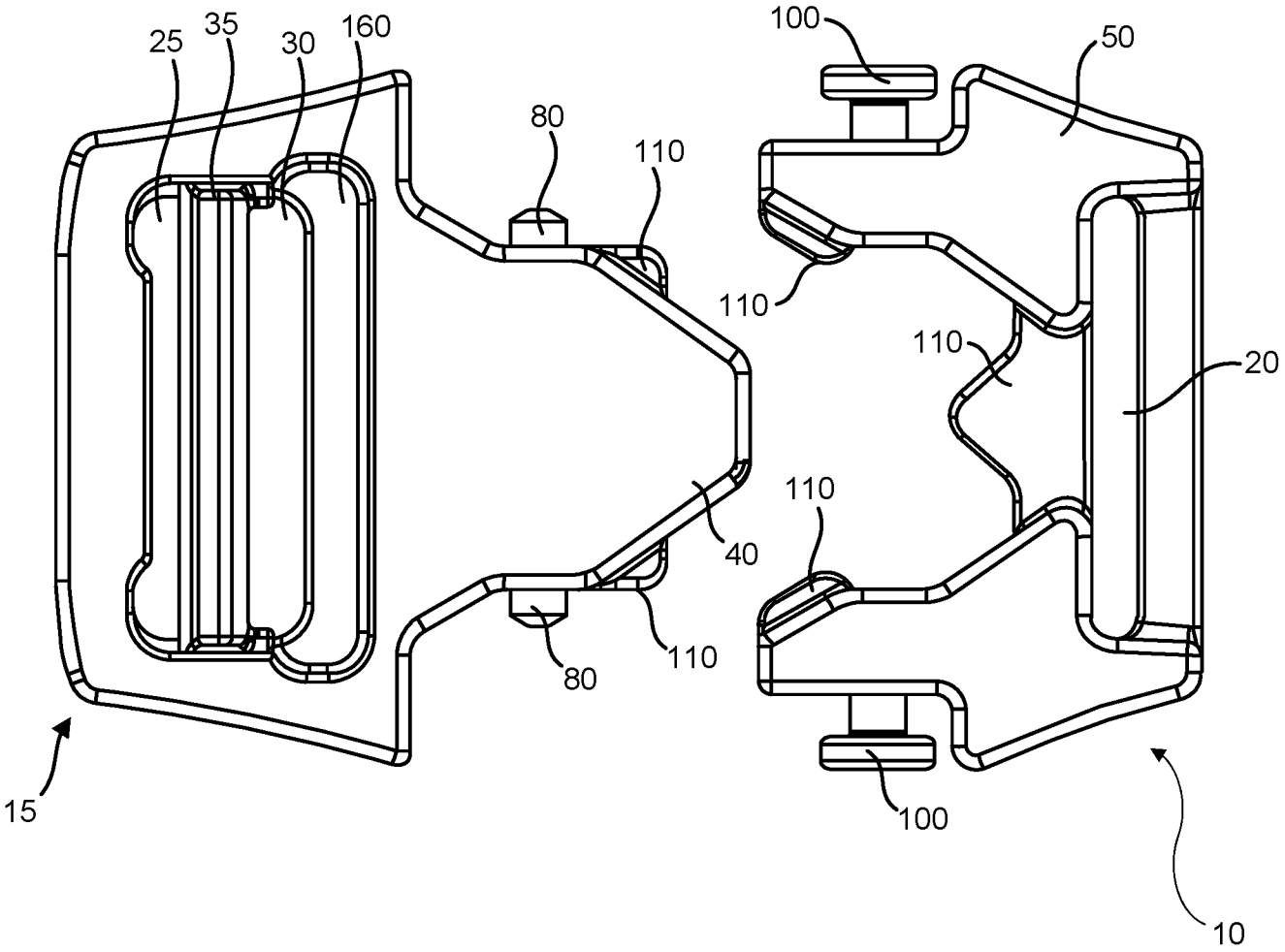
FIG. 4 is a top view of the belt buckle in an open configuration.

Turning to FIGS. 3-4, top and bottom views of the belt buckle in an open configuration are shown. The two ends 10, 15 of the belt buckle 5 are fastened together using a locking system with male 40 and female 50 counterparts. As shown in the figures, the male counterpart 40 of the locking system is an integral part of the adjustable loop end 15 and the female counterpart 50 is an integral part of the fixed loop end 10. However, for purposes of the disclosed buckle 5, the male/female counterparts 40, 50 of the locking system could be reversed with the male counterpart 40 being an integral part of the fixed loop end 10 and the female counterpart 50 being an integral part of the adjustable loop end 15.

The male counterpart 40 of the locking system includes an enclosed grease well 60 with a spring 70 disposed and fully encased within the grease well 60 that is positioned between two opposing pins 80. The spring 70 operates to push the pins 80 out of the grease well 60 in a lateral direction from the male counterpart 40. The use of a fully enclosed grease well 60 keeps the spring 70 from being exposed to the elements, further minimizing risks of corrosion and increasing the lifespan and durability of the locking system and belt buckle 5. The female counterpart 50 is operable to receive the male counterpart 40 and includes corresponding pin casings 90 (as shown in FIGS. 5-8) that are sized and dimensioned to receive the pins 80. On the opposite end of the pin casings 90 from the pins 80 is a pin plunger 100. When fastening the belt buckle 5, the inside wall 105 of the female counterpart 50 is configured to compress the pins 80 inward until the pins 80 are aligned with the corresponding pin casing 90 and are locked in place. When releasing the belt buckle 5, the pin plunger 100 is operable to compress the pins 80 inward and out of the pin casing 90 such that the male counterpart 40 can be freely removed from the female counterpart 50.

Figure 9:
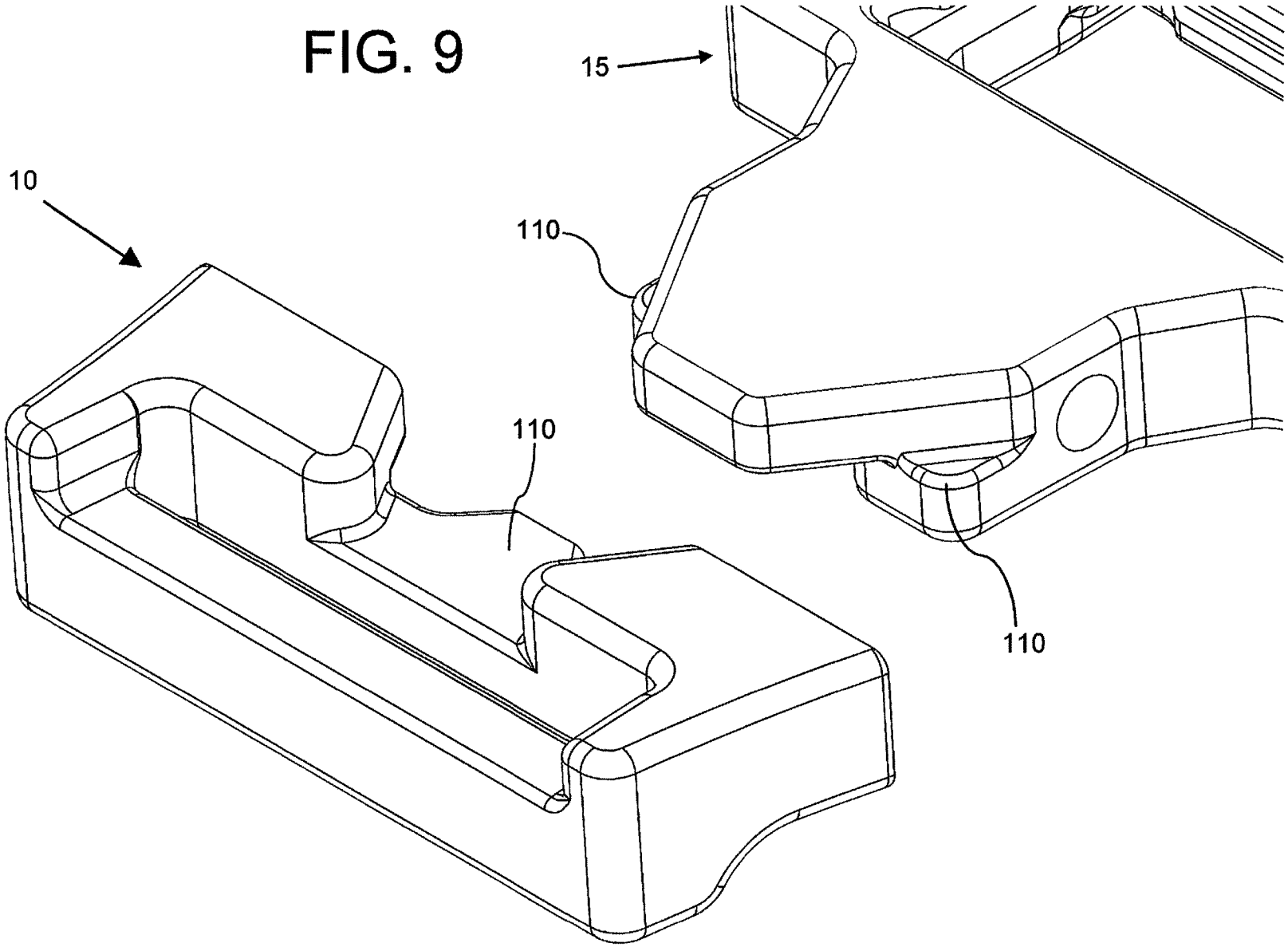
FIG. 9 is a perspective view of the belt buckle showing the tabs.
Figure 10:
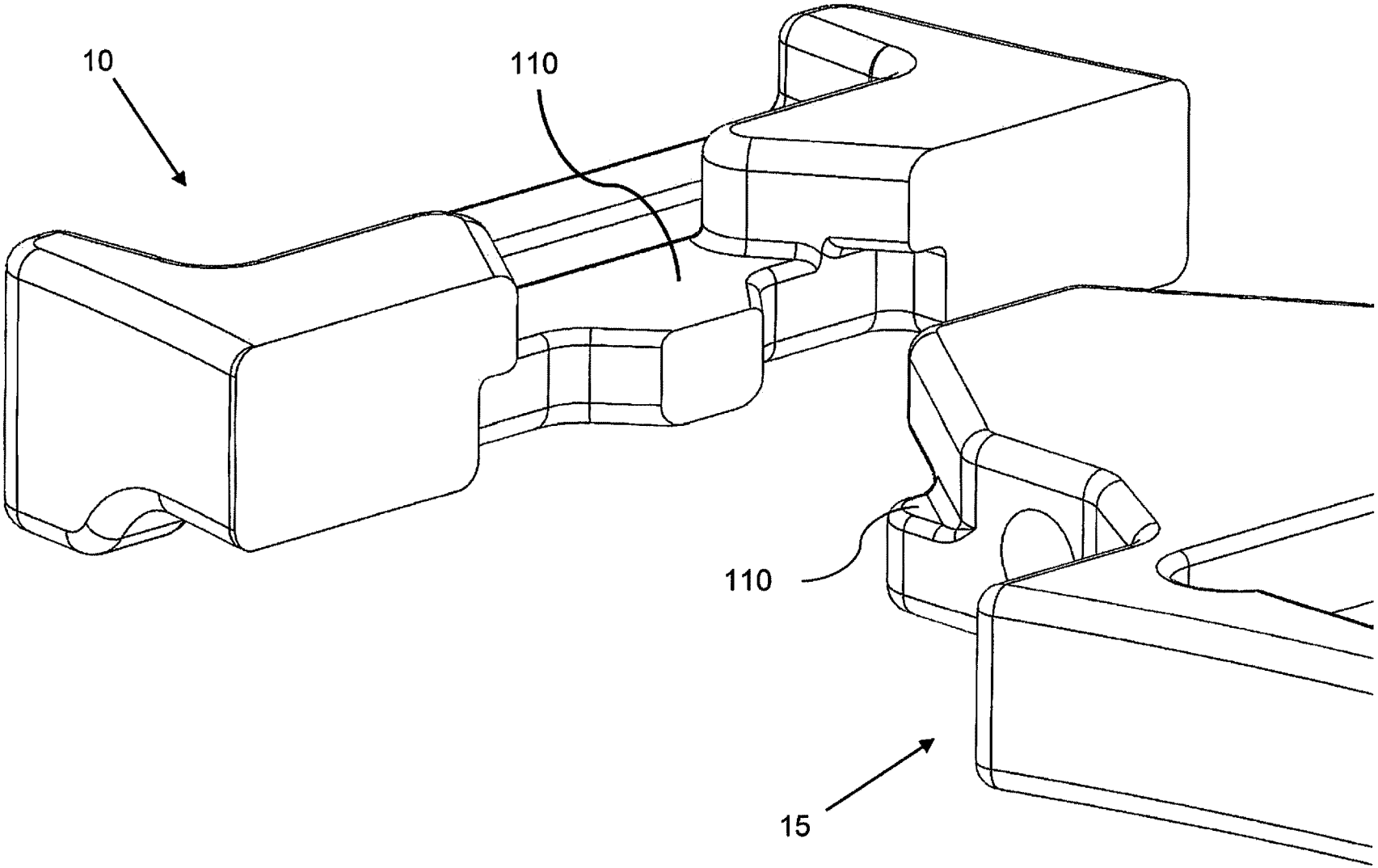
FIG. 10 is an alternative perspective view of the belt buckle showing the tabs.

To assist in guiding the male and female counterparts 40, 50 into a locked, closed configuration, and to prevent the buckle 5 from rotating when external loads are applied, each counterpart 40,50 includes various tabs 110, as depicted in FIGS. 9-10, strategically positioned and configured to improve the performance of the belt buckle 5.

Figure 5:
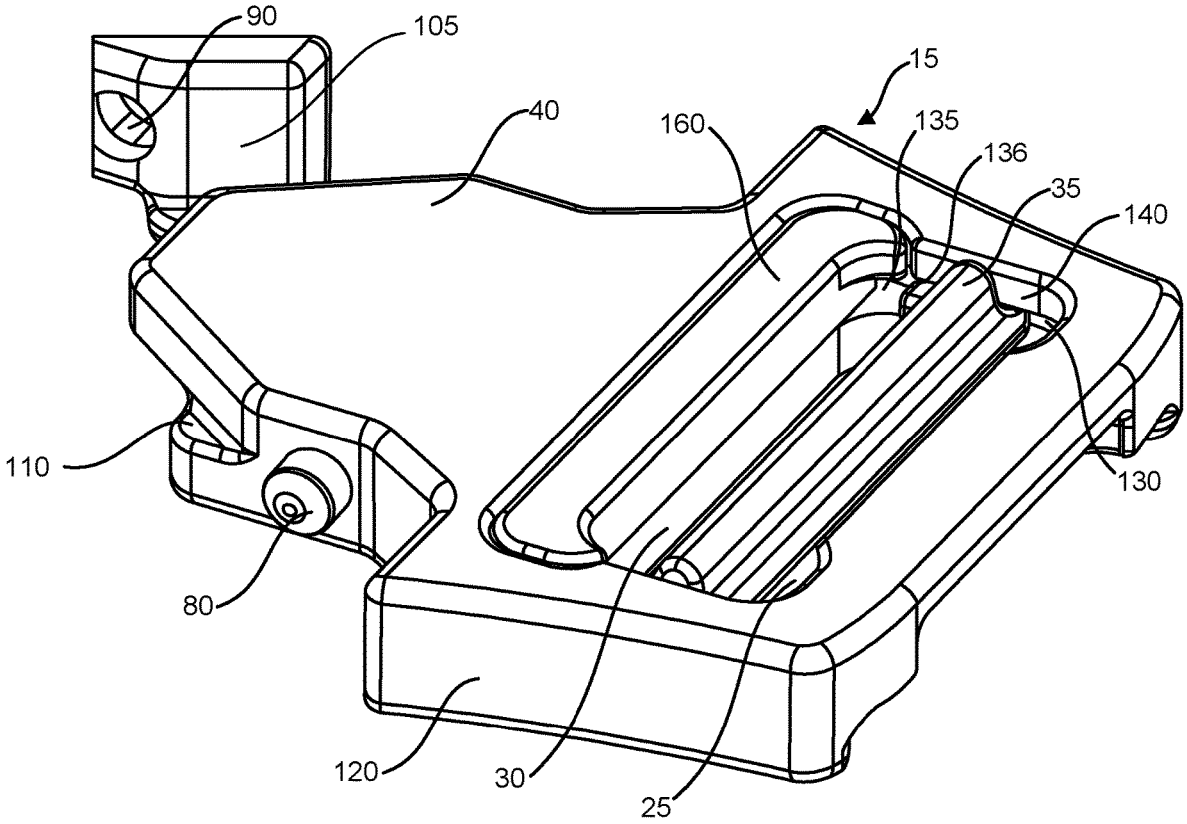
FIG. 5 is a perspective top view of the adjustable loop end of the belt buckle showing the plug inserted in the belt buckle.
Figure 6:
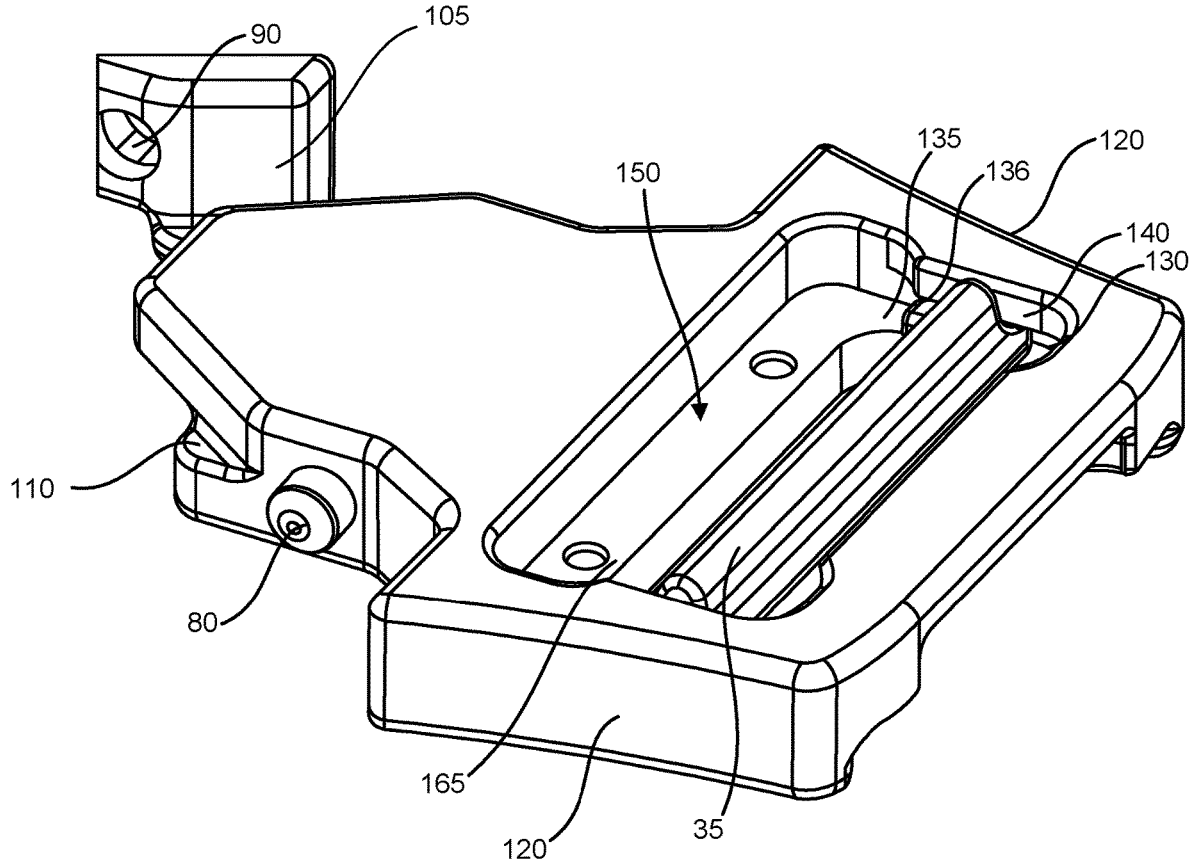
FIG. 6 is a perspective top view of the adjustable loop end of the belt buckle showing the plug removed from the belt buckle.
Figure 7:
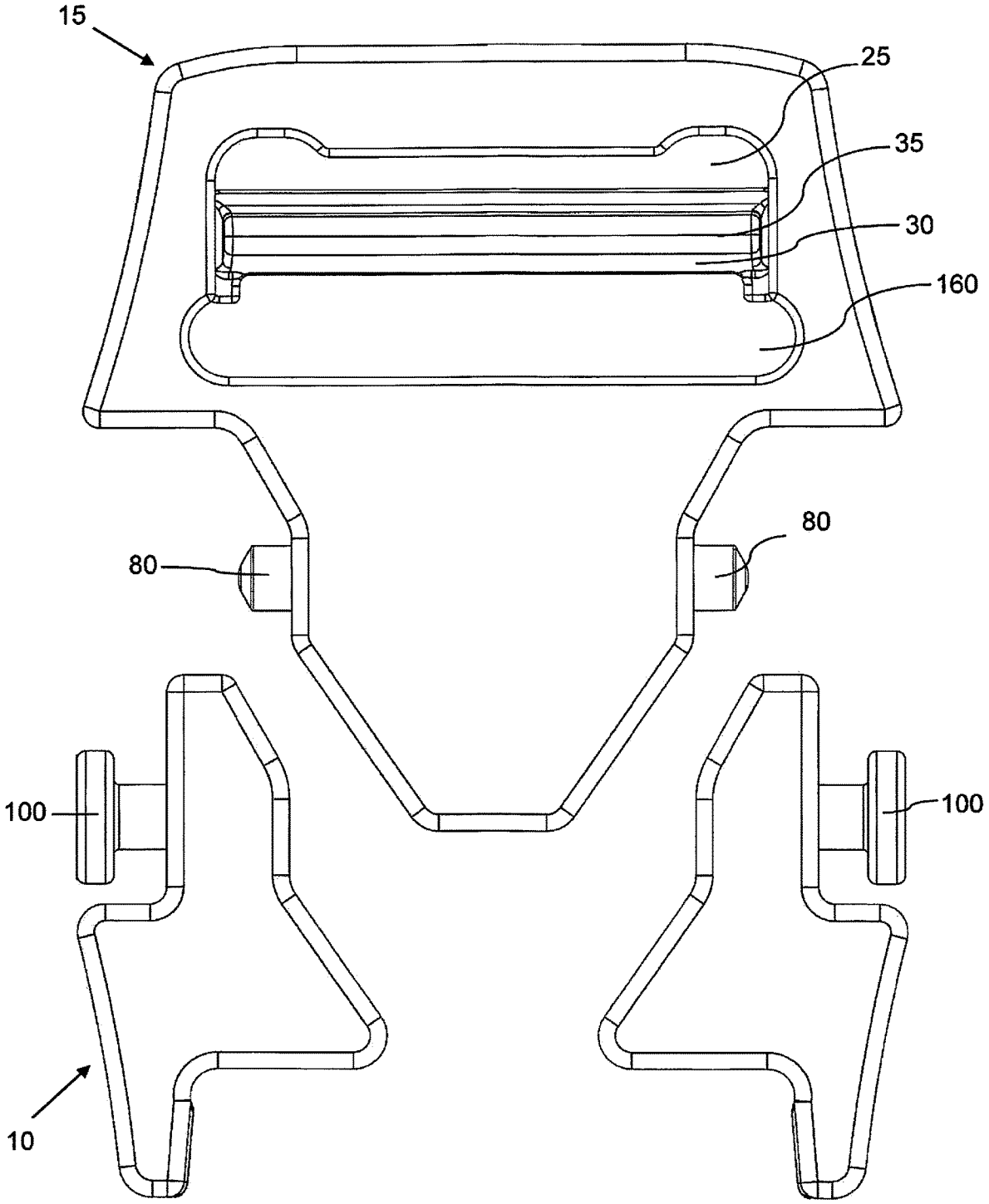
FIG. 7 is a top plan view of the belt buckle in an open configuration.
Figure 8:
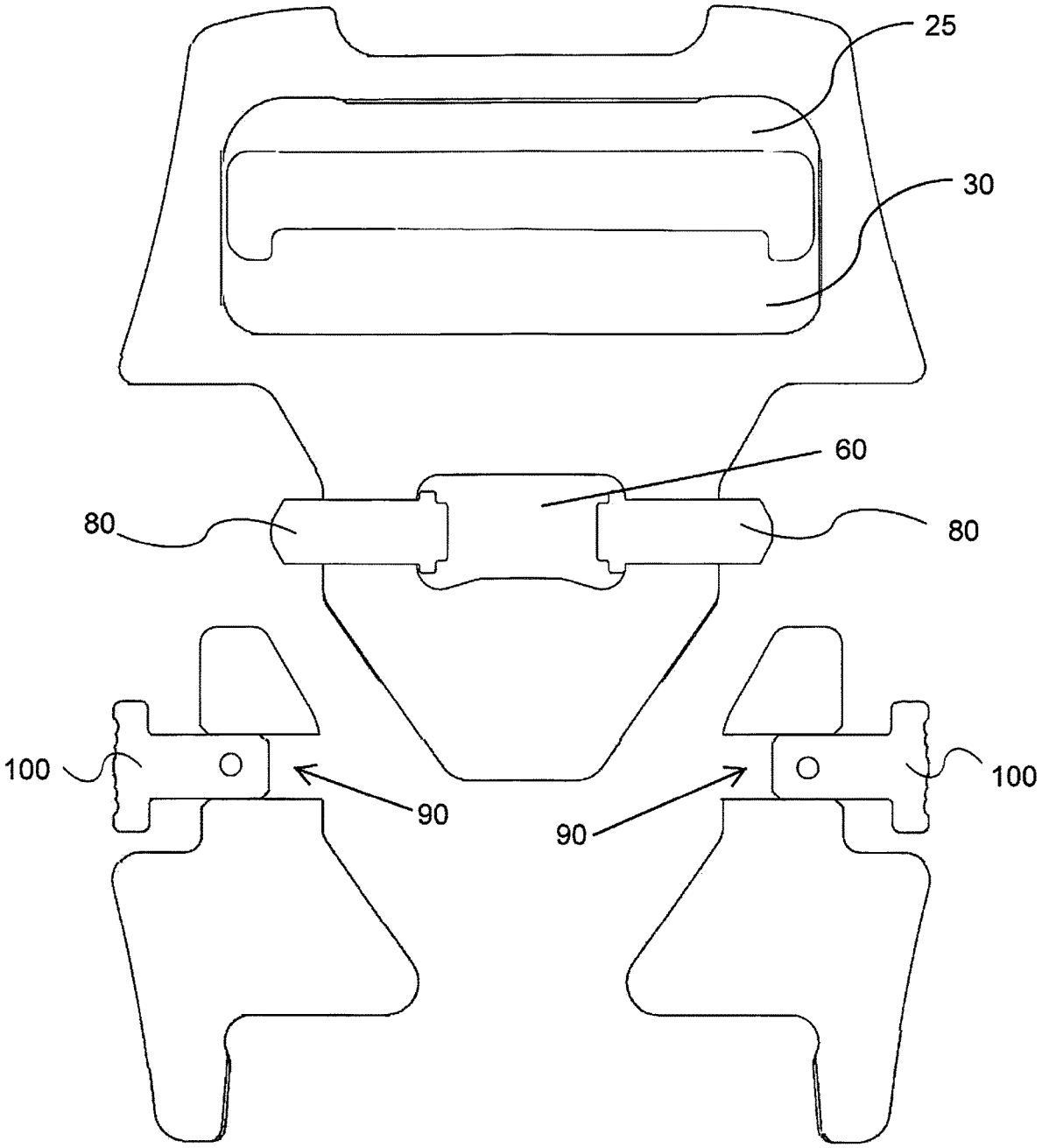
FIG. 8 is a cross-sectional top plan view of the belt buckle in an open configuration.
Figure 11:
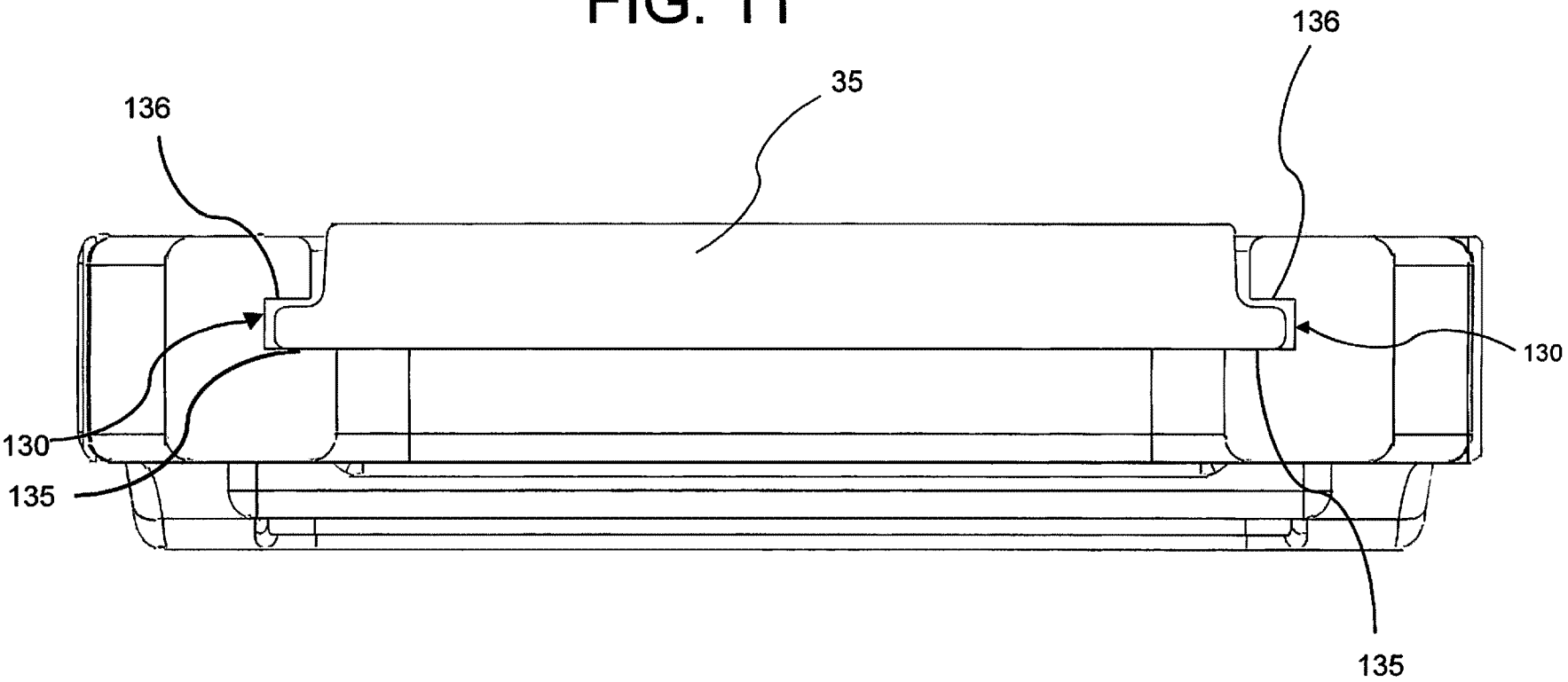
FIG. 11 is cross-sectional side view of the belt buckle showing central bar positioned within the opposing slots.

As shown in FIGS. 5-6, the adjustable loop end 15 has a pair of opposing side walls 120, with a pair of opposing slots 130 recessed into the interior surface 140 of the opposing side walls 120. As shown in detail in FIG. 11, the bottom edges 135 of the slots 130, are longer than the top edges 136; respectively, such that the edges 135, 136 are offset along the vertical axis. The offset of the top 136 and bottom edges 135 allows the thicker sections of the central bar 35 to rest in the slots 130. This configuration removes the load from the thin tabs of the central bar 35 and places it on the thicker, stronger part of the central bar 35 to allow for a much higher load capacity.

For conventional belt buckles, the central bar must be bent and deformed for it to fit within the slots in the opposing walls of the adjustable loop end. Because the central bar is a component of the belt buckle that withstands significant loads, it would be more advantageous to use a material that is stronger than the malleable materials currently being used in the art. As shown in FIGS. 5-6, the bottom edges 135 of the slots 130 extend and form a contiguous bottom surface 165 of an open cavity 150 that is operable to receive a plug 160. The plug 160 may be fastened to the bottom surface 165 of the cavity 150 by a snap fittings or other fastening means known in the art, including but not limited to hook and loop fasteners, snap fasteners, removable adhesive, adhesives, adhesive strips, and thermal bonding agents. When the plug 160 is removed, the central bar 35 may be removed from the adjustable loop end 15 by sliding the central bar 35 along the slots 130 into the open cavity 150 where the central bar 35 can be safely removed and replaced. By removing the need to deform the central bar, stronger, rigid materials (e.g. 17-4 stainless steel) can be used for the central bar 35, further improving the strength and durability of the belt buckle.

A buckle according to the invention can be used, for example, for safety strap or belts for fall protection or for safety strap or belts for aviation sport, particularly for hang-gliding and paragliding. The buckle is also useful for tactical gear usages including, but not limited to, belts, backpack straps, climbing and repelling harnesses, dog collars and harnesses and cargo straps.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A buckle comprising:

a first end comprising two opposing locking pins each having a proximal end and distal end, a spring coupled to the proximal end of each of the locking pins, a well, and two opposing channels extending from the well to an exterior surface of the first end, wherein each channel is configured to receive the distal end of each locking pin, wherein the spring and the proximal ends of the locking pins are disposed within the well, wherein the proximal ends of each locking pin are sized and dimensioned such that the proximal ends are unable to translate through each corresponding channel, wherein the distal end of each locking pin is spring loaded to extend through each corresponding channel a distance until a portion of the distal end extends beyond the exterior surface of the first end, a second end comprising corresponding pin casings, each of said pin casings being operable to receive the locking pins on one end, and each of said pin casings further comprising a plunger disposed on an opposite end, wherein each of the plungers are operable to push the locking pins out of the pin casings, and wherein the first end is removably attached to the second end.

2. The buckle of claim 1 wherein the first end is configured to form a male counterpart and the second end is configured to form a female counterpart that is operable to receive the male counterpart, wherein the female counterpart comprises side walls having an interior and exterior surface, wherein the interior surface of the side walls are configured to compress the locking pins of the male counterpart inward towards the spring as the male counterpart is inserted into the female counterpart.

3. The buckle of claim 1 comprising:

an adjustable loop end forming a primary plane with a pair of opposing side walls, wherein the adjustable loop end is an integral part of either the first or the second end;

a first strap or belt opening extending through the adjustable loop end along a portion of a lateral axis of the primary plane;

a second strap or belt opening extending through the adjustable loop end along a portion of the lateral axis of the primary plane;

a central bar positioned between the first strap or belt opening and the second strap or belt opening along the lateral axis of the primary plane with opposing terminal ends; and a plug that is removably attached to the adjustable loop end and positioned along the lateral axis of the primary plane, wherein the plug is operable to secure the central bar in place during use, wherein removal of the plug is necessary to allow the central bar to be removed from the adjustable loop end.

4. The buckle of claim 3 wherein the plug is attached to the adjustable loop end with a fastener.

5. The buckle of claim 4 wherein the fastener is selected from the group comprising hook and loop fasteners, snap fasteners, removable adhesives, adhesives, adhesive strips, and thermal bonding agents.

6. The buckle of claim 3 comprising a first slot recessed into an interior surface of one of the opposing side walls wherein a bottom edge of the first slot is longer than a top edge of the first slot, and a second slot recessed into an interior surface of one of the opposing side walls wherein a bottom edge of the second slot is longer than a top edge of the second slot, wherein the terminal ends of the central bar rest inside the first and second slots.

7. A buckle comprising:

an adjustable loop end forming a primary plane with a pair of opposing side walls;

a first strap or belt opening extending through the adjustable loop end along a portion of a lateral axis of the primary plane;

a second strap or belt opening extending through the adjustable loop end along a portion of the lateral axis of the primary plane;

a central bar positioned between the first strap or belt opening and the second strap or belt opening along the lateral axis of the primary plane with opposing terminal ends; and a plug that is removably attached to the adjustable loop end and positioned along the lateral axis of the primary plane, wherein, when the plug is attached to the adjustable loop end, the plug remains in a fixed position and operable to secure the central bar in place during use, wherein removal of the plug is necessary to allow the central bar to be removed from the adjustable loop end.

8. The buckle of claim 7 wherein the plug is attached to the adjustable loop end with a fastener.

9. The buckle of claim 8 wherein the fastener is selected from the group comprising hook and loop fasteners, snap fasteners, removable adhesives, adhesives, adhesive strips, and thermal bonding agents.

10. The buckle of claim 7 comprising a first slot recessed into an interior surface of one of the opposing side walls wherein a bottom edge of the first slot is longer than a top edge of the first slot, and a second slot recessed into an interior surface of one of the opposing side walls wherein a bottom edge of the second slot is longer than a top edge of the second slot, wherein the terminal ends of the central bar rests inside the first and second slots.

11. The buckle of claim 7 comprising:

a fixed loop end removably attached to the adjustable loop end, wherein the adjustable loop end further comprises two opposing locking pins coupled to a spring, wherein the locking pins are spring loaded to extend outwardly beyond an exterior surface of the adjustable loop end, and wherein the spring is disposed within a well disposed within a portion of the adjustable loop end, wherein the fixed loop end comprises corresponding pin casings, each of said pin casings being operable to receive the locking pins on one end, and each of said pin casings further comprising a plunger disposed on an opposite end, and wherein the plungers are operable to push the locking pins out of the pin casings.

12. The buckle of claim 11 wherein the adjustable loop end is configured to form a male counterpart and the fixed loop end is configured to form a female counterpart, wherein the fixed loop end comprises side walls having an interior and exterior surface, wherein the interior surface of the side walls are configured to compress the locking pins of the adjustable loop end inward towards the spring as the male counterpart is inserted into female counterpart.

* * * * *